United States Patent [19]

Gressin et al.

[11] Patent Number: 4,726,853

[45] Date of Patent: Feb. 23, 1988

[54] FERRITIC STAINLESS STEEL STRIP OR SHEET, IN PARTICULAR FOR EXHAUST SYSTEMS

[75] Inventors: Pascal Gressin, Ugine; Pierre Pedarre, Annecy; Jean Decroix, Montmorency; Philippe Maitrepierre, Orgeval, all of France

[73] Assignee: Ugine Gueugnon SA, Gueugnon, France

[21] Appl. No.: 923,500

[22] Filed: Oct. 27, 1986

[30] Foreign Application Priority Data

Nov. 5, 1985 [FR] France ..... 85 16781

[51] Int. Cl.[4] ..... C22C 38/28; C22C 38/50; C21D 8/02

[52] U.S. Cl. ..... 148/12 EA; 148/325; 148/326; 148/332; 148/336; 420/60; 420/61; 420/68; 420/69; 420/70

[58] Field of Search ..... 148/325, 326, 332, 336, 148/12 EA; 420/34, 60, 61, 68, 69, 70

[56] References Cited

U.S. PATENT DOCUMENTS 4,155,752 5/1979 Oppenheim et al. ..... 420/61

*Primary Examiner*—L. Dewayne Rutledge
*Assistant Examiner*—George Wyszomierski
*Attorney, Agent, or Firm*—Dennison, Meserole, Pollack & Scheiner

[57] ABSTRACT

The invention concerns a strip or sheet of ferritic stainless steel of the following composition (% by weight):

(C+N)<.060;
Si<0.9;
Mn<1;
Cr=15 to 19;
Mo<1;
Ni<0.5;
Ti<0.1;
Cu<0.4;
S<0.02;
P<0.045;
Zr=0.10 to 0.40, and 7(C+N)≦Zr≦7(C+N)+0.15;
Nb=0.25 to 0.55, in non-combined form;
Al=0.020 to 0.080;
Fe=the balance, in which Al is essentially in solid solution.

The process for the production of the sheet or strip comprises a final annealing operation which is carried out at between 980° and 1020° C., typically for 0.5 to 5 minutes at between 990° and 1010° C.

The strip or sheet according to the invention is used for any application requiring an economic compromise in regard to ductility (sheet and welds), hot resistance and resistance to corrosion, for example in motor vehicle exhaust manifolds.

9 Claims, 6 Drawing Figures

FERRITIC STAINLESS STEEL STRIP OR SHEET, IN PARTICULAR FOR EXHAUST SYSTEMS

Figure 1:
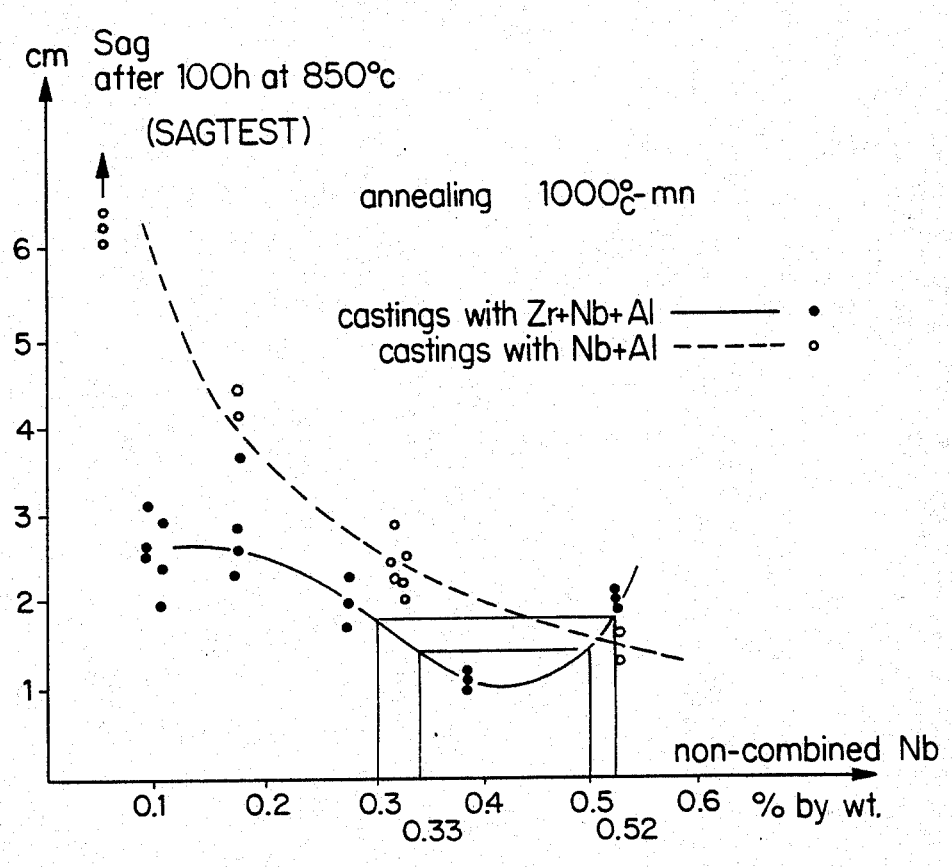

The invention concerns the field of rolled products of ferritic stainless steel and more particularly the field of exhaust systems.

STATEMENT OF THE PROBLEM

A certain number of requirements which are difficult to meet simultaneously and economically, as set out below, are involved in manufacturing exhaust systems, for example motor vehicle exhaust pipes and manifolds, and keeping them in a serviceable condition:

- good ductility of the welds without filler metal for producing the configuration of the parts, and fatigue,
- good resistance to creep in the hot condition (SAGTEST);
- good resistance to oxidation in the hot condition, whether continuous or cyclic, both in regard to the actual sheet and in regard to the welds; and
- good resistance to corrosion, in particular in regard to spraying and splashing of salt water due to the salting of roads during the winter.

The applicants have endeavoured to improve the compromises in respect of properties which are attained with strips or sheets of the compositions which are already known, and more particularly with ferritic stainless compositions which are stabilised with Nb and/or Zr, in particular as regards resistance to creep and to hot oxidation. Ferritic stainless compositions are superior to austenitic compositions, by virtue of their coefficient of thermal expansion.

KNOWN STATE OF THE ART

U.S. Pat. No. 4,010,049 concerns a ferritic stainless steel of the following composition: C 0.10% maximum; Cr 11 to 30%; Mo 3% maximum; Nb (columbium) 0.1% total to 0.3% in solid solution and not less than $7.7\times C\%-(Zr\%-6.5\times N\%)$; Zr 6.5 N% to $0.25\%+(7.6\%\ C+6.5\%\ N)$; Fe and residual impurities as the balance. That document gives a number of items of information regarding the function of Zr and Nb:

- the order in regard to the ease of formation of nitrides and carbides is as follows: "Zr nitride, Zr carbide, Nb carbide and Nb nitride", and C and N are therefore preferentially trapped by Zr, and in a more stable manner than by Nb;
- zirconium exceeding by more than 0.25% the amount required to combine with C and N causes a substantial deterioration in ductility and resistance to corrosion;
- niobium in solid solution must not exceed 0.3%, or it will give rise to the welds having a poor level of ductility; the fragility may be due to the formation of an intermetallic compound $Nb_2(Fe,Cr)_3$.

In the paper presented to the Congress of the S.A.E. in Detroit, Mich., Feb. 23 to 27, 1981 ("Influence of Columbium on the 870° C. Creep Properties of 18% Chromium Ferritic Stainless Steels"), John N. JOHNSON studies the resistance to creep under traction at 870° C. of different 18% Cr ferritic stainless steels containing Ti+Nb, and finds that the creep results are improved by reannealing the samples (which have already been annealed at the factory), at temperatures ranging from 1040° to 1150° C., for example for 30 minutes at 1095° C. Materials having proportions of Nb which is not combined, of from 0.3 to 0.6%, comprise large amounts of Nb-based intergranular precipitates and the effect of the second annealing operation was to dissolve such precipitates and to increase the grain size.

Two documents indicate the influence of the addition of Al. FR-A-2 463 194 is concerned with ferritic steels containing from 1 to 20% Cr and Ti, Nb, with 0.5 to 2% Al, in which a minimum amount of Al of 0.5% and preferably 0.75% is necessary to ensure resistance to oxidation at elevated temperature. Above a level of 2%, Al has a harmful effect on suitability for welding. In JP-A-82/146440, a ferritic stainless steel contains from 0.08 to 0.5% Al and one or more of the following elements: B (2–50 ppm), Ti (0.005–0.4%), Nb (0.005–0.4%), V (0.005–0.4%) and Zr (0.005–0.4%), and Al gives rise therein to structural modifications at the various stages of conversion into sheet, with an increase in "ridging resistance".

STATEMENT OF THE INVENTION

The invention concerns a strip or sheet of ferritic stainless steel, usually in the annealed state, the final annealing operation then being followed in most cases by a finishing and cold-working pass or "skin pass", producing a degree of elongation of less than 1%, intended in particular for the production of exhaust pipes and manifolds. The composition of the strip or sheet is as follows (% by weight):

$(C+N)<0.060$-Si$<0.9$-Mn$<1$

Cr 15 to 19-Mo$<1$-Ni$<0.5$-Ti$<0.1$-Cu$<0.4$-S$<0.02$-P$<0.045$

Zr=0.10 to 0.50 with Zr between $7\ (C+N)-0.1$ and $7\ (C+N)+0.2$ Nb between 0.25 and 0.55 if $Zr\geqq 7\ (C+N)$ and between $0.25+7\ (C+N)-Zr$ and $0.55+7\ (C+N)-Zr$ if $Zr<7\ (C+N)$ Al 0.020 to 0.080—other elements and Fe: balance.

Zr is consumed by stabilisation, that is to say by the trapping of C and N in the form of nitrides and carbides, up to a maximum of about 7 (C+N)%. The free Zr is therefore limited to 0.2%, which makes it possible to avoid the disadvantages involved in the formation of eutectic compounds containing $Fe_3Zr$ in the situation where there is more than 0.25% of free Zr, such compounds giving rise to a fall in the mechanical characteristics, in particular in ductility and resistance to creep, and a drop in resistance to corrosion, as indicated in broad outlines by US-A-4 010 049.

At the above-indicated proportion which is at most equal to 0.2%, the free Zr has no substantial direct influence on resistance to oxidation.

The free or non-combined Nb is between 0.25 and 0.55%. The total Nb comprises, in addition to the free Nb, an additional amount of $7\ (C+N)-Zr$, in order to make up for the deficiency in regard to stabilisation due to the insufficiency of Zr, in the case where Zr is between $7\ (C+N)-0.1$ and $7\ (C+N)$.

It is known from Johnson (see the document quoted above) that the free or non-combined Nb increases the resistance to creep at a level of 0.3 to 0.6% when the samples tested have been annealed at least 1040° C. However, in annealing tests on vertical sheets according to the invenion, of a thickness of 1 mm, carried out at 1040° C. for a period of 5 minutes and at 1150° C. for 1 minute, it was found that deformation of the sheet due to unacceptable creep occurred with such elevated annealing temperatures. It was also observed that annealing at 1000° C. for 1 minute gave good results in regard to creep and ductility for the sheets according to the invention, and that generally an annealing operation at 1000±10° C., for a period of between 0.5 and 5 minutes, was appropriate, which is much easier to carry out on an industrial scale than an annealing operation at a temperature of at least 1040° C. As regards the poor ductility of the welds, as referred to in U.S. Pat. No. 4,010,049, when Nb in solid solution (that is to say free or non-combined) is present in a proportion of higher than 0.3%, and that in the case of 18% Cr ferritic stainless sheets, with Nb+Zr, that disadvantage does not arise with the sheets of the invention in which TIG welds without filler metal are extremely ductile.

The quantitatively controlled total amount of Al essentially corresponds to Al in solid solution. Indeed, Zr has more affinity than Al for oxygen and there is little residual oxygen in the metal so that there can only be very little Al in the form of alumina. Moreover, the affinities of Zr and Nb for nitrogen and the greater affinity of Al for oxygen than for nitrogen mean that no aluminium nitride AlN is formed. The result which has been conformed qualitatively by micrographic examination is that Al is in solid solution except for an amount which is at most equal to 0.003% and which essentially corresponds to alumina. With a small addition of 0.020 to 0.080% of Al, a surprising improvement in the level of resistance to hot oxidation is achieved, linked to the function of the aluminium in solid solution, whether that involves continuous oxidation in the air at between 800° and 1000° C. or alternating cyclic oxidation, in the actual sheet or at welds. Thus, in regard to continuous oxidation in the air for a period of 50 hours, the limit temperatures corresponding to a weight loss of 200 g/m$^2$ are 970° C. for Al<0.002%, 1020° C. for Al=0.036% and 1070° C. for Al=0.090%. In regard to continuous oxidation at 1000° C. for a period of 50 hours, the weight losses produced are as follows:

TABLE 1

| Al (%) | <0.002 | 0.020 | 0.025 | 0.040 | 0.045 | 0.080 |
|---|---|---|---|---|---|---|
| g/m$^2$ | 310 | 230 | 215 | 185 | 175 | 145 |

The weight loss is thus reduced by 26% by virtue of the presence of 0.020% Al and by 53% by virtue of the presence of 0.080% of Al. The amount of Al is limited to 0.080% so as to avoid surface scum or dross on weld beads, giving rise to irregular oxidation phenomena and cracks and splits in the conformation and therefore more rapid levels of corrosion, as was found by experience with 17% Cr stainless steels (type AISI 430). The above-indicated effect regarding surface scum or dross is substantial at a level of 0.1% Al but if there is a wish also to avoid or limit the inclusions of alumina which are linked to the presence of an excess of aluminium, which inclusions constitute sites for the start of cracking as a result of spraying or splashing of salt water due to the salting of roads, or the removal of salt therefrom, during the winter, it is appropriate to remain below a value of 0.05% Al, as is done in the preferred composition set forth hereinafter.

An attempt was made to explain that surprising improvement in the resistance to oxidation which is achieved by such small proportions of aluminium. A study was carried out on samples of sheet of a thickness of 1 mm, coming in particular from two castings containing 16% Cr without Zr, No 101 and No 401, one containing 0.6% Nb and 0.048% Al, and the other containing 0.45% Nb without Al (Al<0.002%), which were oxidised in the air in a continuous mode for a period of 50 hours at 900° C. In the case of the first casting containing Nb and Al, it was found that the oxidised layer, of a thickness of 10 μm, was anchored to the sheet by small plates of typical unitary dimensions of 0.3 to 0.8 μm, containing alumina and niobium in some places, in the form of inclusions of a compound of Nb. That anchoring mechanism is entirely different from the mechanism involved in the formation of a layer of alumina, which is particular to ferritic stainless compositions with a proportion of Al of higher than 0.5%.

In the case of the second casting without Al, there is no anchoring effect and, by light discharge spectrograph examination, it was verified that there was no Nb at the metal/oxidised layer interface.

It can therefore be concluded that, in the case of the Zr-Nb-Al sheets according to the invention, Al may be involved in conjunction with Nb to produce an anchoring effect which is favourable to the hold of the oxidised layer on the sheet, thus improving the resistance to corrosion in the hot condition. Moreover, in a series of tests involving alternate oxidation at 800° C., samples of sheet according to the invention containing Zr-Nb-Al showed, beyond 350 hours of testing, a better level of resistance than samples of sheet containing Nb-Al but without Zr, having comparable proportions of non-combined Nb and Al, which seems to show that Zr plays a part in the above-indicated resistance to alternate or cyclic oxidation.

The constituent elements of the strip or sheet according to the invention are considered individually or in their totality in the following preferred ranges of proportions:

(C+N)<0.040-Si<0.8-Cr 16 to 18

Mo<0.3-Ni<0.3-Ti<0.05-S<0.01

Zr=0.10 to 0.40 with Zr between 7 (C+N) and 7 (C+N)+0.15

Nb 0.30 to 0.52 and more preferably 0.33 to 0.50

Al 0.020 to 0.045 and more preferably 0.025 to 0.040.

The maximum amounts of (C+N) and Zr can thus be reduced simultaneously, giving a higher degree of security in regard to ductility of the solid sheet and the welds as well as in regard to resistance to corrosion. Zr is then still in a sufficient amount for stabilisation in the restricted sense, that is to say for trapping N and C in the form of nitrides and carbides. Nb is entirely available in regard to the resistance to creep in the hot condition and included in the ranges of proportions which give the minimum of sag in the SAGTEST tests at 850° C. Al may be contained in increasingly narrow ranges of proportions, which can be achieved in an industrial context and which represent an optimum compromise between resistance to hot oxidation and resistance to pitting corrosion.

In the state as delivered, the strip or sheet according to the invention is in the tempered and optionally trimmed or dressed condition, the tempered condition typically corresponding to a treatment at 1000±10° C. for a period of 0.5 to 5 minutes.

The invention also concerns the process for the production of a strip or sheet of ferritic stainless steel wherein, as is known, the hot rolled strip of a thickness of between 2.5 and 5 mm is tempered at between 800° and 1000° C. under substantially non-oxidising conditions and is then shot-blasted and cleaned, then it is rolled cold to the thickness for delivery which is typically between 0.6 and 3 mm, with or without intermediate annealing and cleaning operations, and it is subjected to final tempering in a moving mode, then it is subjected to a finishing or cold working pass referred to as a skin pass, producing a degree of elongation of less than 1%, with optionally a final cleaning operation. That process is distinguished from the prior art in that the strip or sheet is of the composition according to the invention and that the annealing operation which makes it possible to achieve good results in regard to hot creep is carried out at between 980° and 1020° C. and preferably between 990° and 1010° C. for a period of 0.5 to 5 minutes, or at a temperature and for a period which give an equivalent metallurgical state. The final annealing operation is typically carried out following a rolling operation producing a degree of elongation of at least 100%, from the preceding annealing operation.

The results of tests as set out below and the figures and the tables which accompany same illustrate and provide comment on the various aspects of the invention.

TESTS

Test series No 1—Hot creep tests

A certain number of laboratory castings were produced, each weighing 25 kg, the analysis thereof being set forth in Table 2 (castings with Nb+Al) and in Table 3 (castings with Zr+Nb+Al).

Other impurities were analysed: W<0.003-V=0.02 to 0.06-Sn<0.003-Co 0.01 to 0.02-Ti=0.004 to 0.013-Pb<0.002-Ta<0.01-Se<0.002-Mg<0.0002-Ca=0.0001 to 0.0003-O=0.0036 to 0.0172%.

The total of the other impurities is thus markedly lower than 0.3% and Fe forms the balance.

The main steps in conversion into sheets of a thickness of 1 mm were as follows:

hot forging to a thickness of 14 mm,
grinding true the two faces, to a thickness of 12 mm,
hot rolling to a thickness of 3 mm,
annealing for 4 hours at 800° C.,
cleaning,
cold rolling to a thickness of 1 mm,
annealing at 1000° C. for 1 minute or 5 minutes.

Rectangular testpieces measuring 310×25 mm were cut out from the sheets and they were folded at 90° at a distance of 25 mm from one end. They were then positioned flat, each on two supports with an internal spacing of 254 mm and an external spacing of 264 mm, and they were subjected to continuous SAGTEST tests in regard to creep under their own weight for a period of 100 hours at 850° C.

Figure 2:
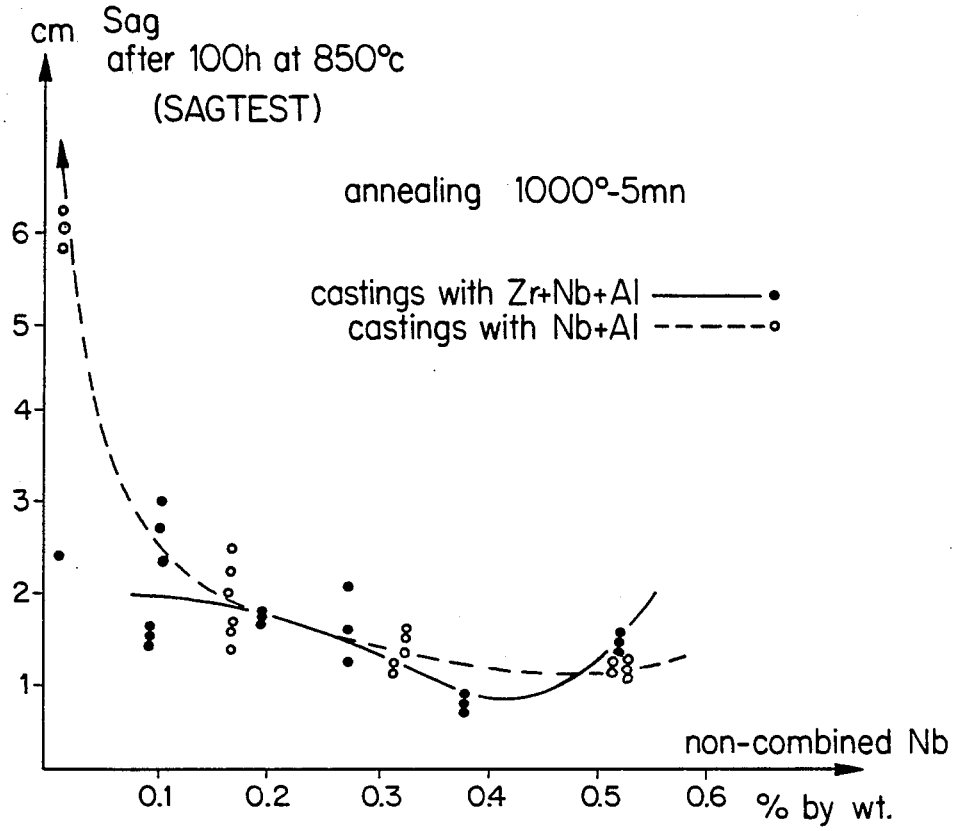

The graphs shown in FIGS. 1 and 2 indicate the degrees of sag observed after 100 hours at 850° C., while Tables 4 and 5 show the mean degrees of sag (the mean of three results) obtained for the testpieces from the castings of Table 2 and for those of Table 3.

Those results show three tendencies:

the Nb+Al testpieces (Table 4 and FIGS. 1 and 2) have an improved resistance to creep in proportion to an increased amount of free Nb, and the preliminary annealing operation at 1000° C. for a period of 5 minutes gives results, with the same amount of free Nb, which are much better than the tempering operation at 1000° C. for 1 minute, and that applies in regard to all the range tested (0.1 to 0.54% of free Nb);

the testpieces containing Zr+Nb+Al (Table 5 and FIGS. 1 and 2) give much better results than the testpieces containing Nb+Al with the annealing operation at 1000° C. for 1 minute, and which are only a little less good than those obtained with the similar Zr+Nb+Al testpieces which were annealed for 5 minutes at 1000° C., more especially at between 0.25% and 0.55% of free Nb, in which range the results in respect of the amounts of sag differ only by about 0.3 to 0.7 cm. The suitability of the Zr+Nb+Al castings according to the invention, to give relatively good resistance to creep, even after a limited annealing operation of that kind (1000° C. for 1 minute) is a very important industrial advantage;

the Zr+Nb+Al testpieces, whether they were annealed at 1000° C. for 1 minute or 5 minutes, have maximum resistance to creep in the hot condition (SAGTEST at 850° C. for 100 hours), that is to say, a minimum sag at between 0.30 and 0.52% of free or non-combined Nb, or better at between 0.33 and 0.50% of free Nb.

The configuration of the curves concerning the Zr+Nb+Al castings, which is different from those relating to the Nb+Al castings (FIGS. 1 and 2) is not completely explained by the conventional considerations and observations regarding intergranular precipitation of intermetallic iron-niobium and recrystallisation phases.

The sheet according to the invention, with an amount of non-combined Nb of between 0.25 and 0.55% and with preferably the above-indicated ranges, are thus distinguished by their level of resistance to creep in the hot condition. Tests in regard to creep under tensile load at 800° C. have in that respect confirmed the SAGTEST tests.

Test series No 2—Ductility of welds

Sheets of a thickness of 2.5 mm and annealed for 4 hours at 800° C., produced from four of the previous castings, were used. Those sheets were then used to produce thereon full-sheet welds (fusion lines) of a back width of 2 mm, in the automatic TIG mode on a bar with a width of groove of 10 mm, under pure argon, with 12V-250 A and at a rate of 0.50 m/min. Successive tests in respect of bending of the welds were then carried out, both in the transverse direction of the welds and in the lengthwise direction: at an angle of 90° and then at an angle of 180°, around a radius of 5 mm and then a radius of 2.5 mm and then in a block mode (radius zero).

The results are set out in Table 6 below, "G" meaning "good" and "p" meaning "poor" (cracking or splitting). There are four tests per condition.

TABLE 6

| | | Type of casting | | | | |
|---|---|---|---|---|---|---|
| | | With Nb + Al | | With Zr. + Nb + Al | | |
| Casting No (% free Nb) | | 495 (0.325) | 377 (0.541) | 445 (0.277) | 308 (0.385) | 446 (0.515) |
| Transverse bending of the weld | Block mode | 4P | 4P | 4G | 4G | 4G |
| | r = 2.5 mm | 1G + 3P | 1G + 3P | " | " | " |
| | r = 5 mm | 3G + 1P | 3G + 1P | " | " | " |

TABLE 6-continued

| | | Type of casting | | | | |
|---|---|---|---|---|---|---|
| | | With Nb + Al | | With Zr + Nb + Al | | |
| Casting No (% free Nb) | | 495 (0.325) | 377 (0.541) | 445 (0.277) | 308 (0.385) | 446 (0.515) |
| | 90° | 4G | 4G | " | " | " |
| Lengthwise bending of the weld | Block mode | 1G + 3P | 1G + 3P | 4G | 4G | 4G |
| | r = 2.5 mm | 4G | 4G | " | " | " |
| | r = 5 mm | " | " | " | " | " |
| | 90° | " | " | " | " | " |

The welds of the sheets according to the invention all exhibit a very good level of ductility, in contrast to the Nb+Al sheets, even in the case of casting No 445 in which the amount of Zr is slightly less than 7 (C+N).

Test series No 3—Tests involving continuous oxidation in the air at between 800° and 1050° C.

The samples used come from three castings of 25 kg, which are converted in accordance with the process set forth in relation to test series No 1, the cold rolling operation being stopped at a thickness of 1.5 mm and being followed by an annealing operation under vacuum for 1 hour at 830° C. Analysis of the three castings, containing 0.4% Nb and with an increasing proportion of Al, is set forth in Table 7. The samples are plates measuring 20×30 mm, which are punched out from the 1.5 mm tempered sheets and then polished electrolytically in an aceto-perchloric bath (88-12) at ambient temperature for a period of 5 minutes, and then weighed in mg. Each oxidation test relates to three testpieces of the same type, with an additional testpiece for metallographic examination.

Tests in respect of oxidation in hot air are of a uniform duration of 50 hours, the air being renewed by a "chimney effect" by means of a hole of $\phi$6 mm provided in the lower part of the furnace. After the test, the oxides formed are removed by electrolytic cleaning in a neutral medium, and it is the loss of weight of the samples per unit of surface area (in g/m$^2$) which makes it possible to evaluate, on a "counterpart basis", the level of resistance to oxidation in the hot condition. The results on the three testpieces of each test are closely grouped in the case of continuous oxidation and consequently just a single result is given in that case, being the average of the three individual results.

Figure 3:
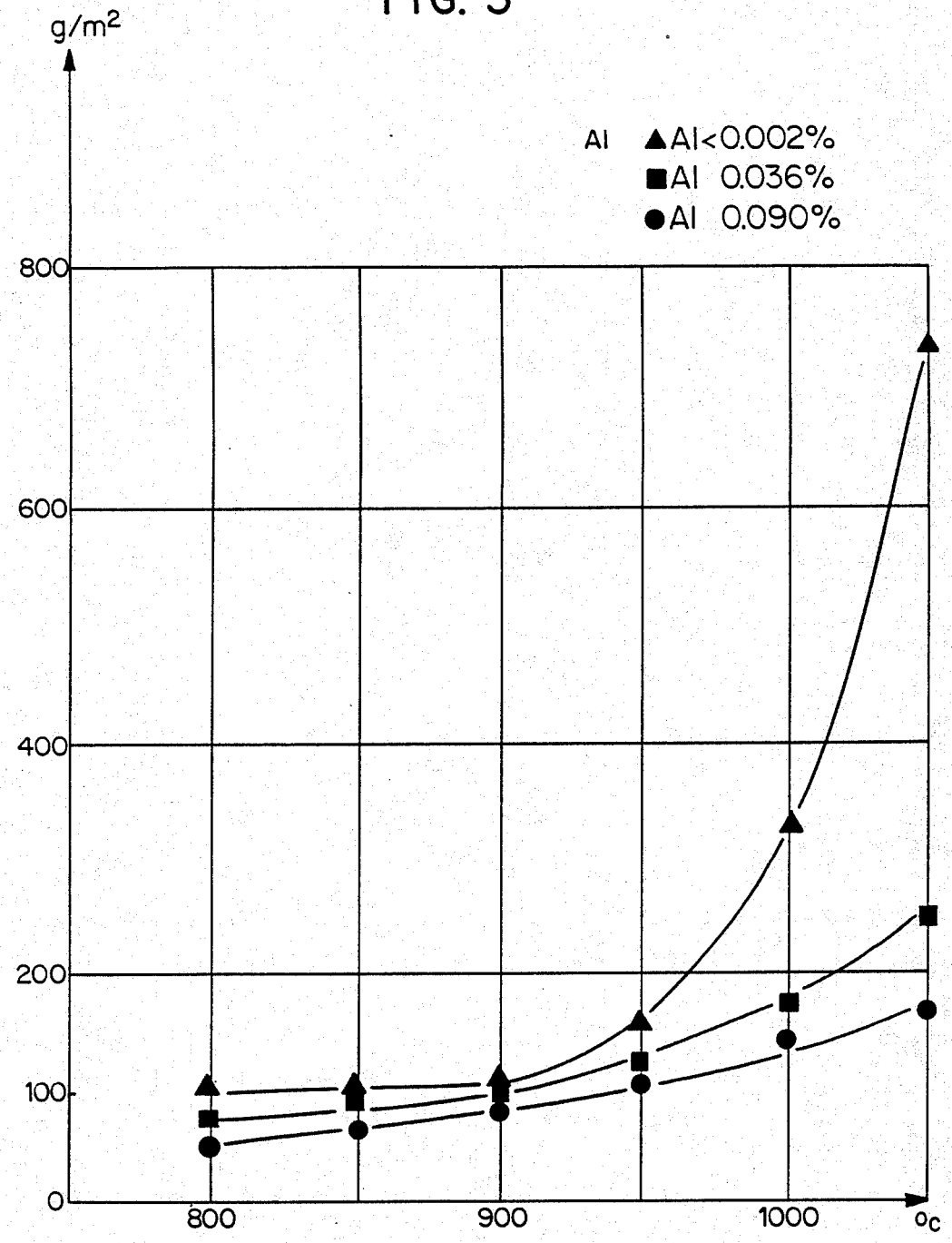

This test series No 3 related to oxidation at graded temperatures differing from each other by 50° C. between 800° C. and 1050° C., the results being set forth in Table 8 and in FIG. 3.

TABLE 8

| Casting No (% Al) | Weight loss due to oxidation (g/m$^2$) 800° C. | 850° C. | 900° C. | 950° C. | 1000° C. | 1050° C. |
|---|---|---|---|---|---|---|
| 401 (<0.002) | 100 | 103 | 110 | 155 | 330 | 740 |
| 402 (0.036) | 75 | 85 | 95 | 125 | 172 | 250 |
| 403 (0.090) | 50 | 65 | 85 | 110 | 144 | 165 |

Looking at Table 8 and FIG. 3, it will be seen that Al in an amount as small as 0.036% greatly improves the resistance to oxidation in the hot condition above 950° C. If for example 200 g/m$^2$ in 50 hours is taken as the limit, it will be seen that the limit temperatures are staggered as already indicated in the Statement of the Invention. As will be verified in test series No 4, those observations relating to Nb castings apply to Zr+Nb castings, and in particular the castings according to the invention.

Test series No 4—Tests in respect of continuous oxidation in the air for 50 hours at 1000° C.

In addition to testpieces from the three preceding castings, this series involved testing testpieces from two Nb castings with respective amounts of Al of 0.525% and 1%, and two castings according to the invention containing 0.04% Al (Nos 201 and 202), the analysis in respect of which is also to be found in Table 7. The results are set forth in Table 9 and in FIG. 4. It will be seen that the points which are representative of the two castings according to the invention are correctly positioned on the weight loss curve plotted for the Nb castings. The presence of the aluminium results in a weight loss which is reduced by 50% with 0.04% Al, 80% with 0.10% Al and which then remains virtually unchanged beyond 0.3% Al, the weight loss then reaching a ceiling at 100 g/m$^2$, being the asymptote of the curve. The weight losses corresponding to the limit proportions of Al in the steels of the invention are set forth in Table 1 (statement of the invention).

TABLE 9

| Weight loss (g/m$^2$) after oxidation for 50 hours at 1000° C. | Type of casting | | | | | | |
|---|---|---|---|---|---|---|---|
| | 16% Cr + Nb | | | | | invention | |
| Casting No | 401 | 402 | 403 | 404 | 405 | 201 | 202 |
| Al % | <0.002 | 0.036 | 0.090 | 0.525 | 1.00 | 0.041 | 0.039 |
| g/m$^2$ | 310 | 182 | 142 | 103 | 101 | 170 | 198 |

Figure 4:
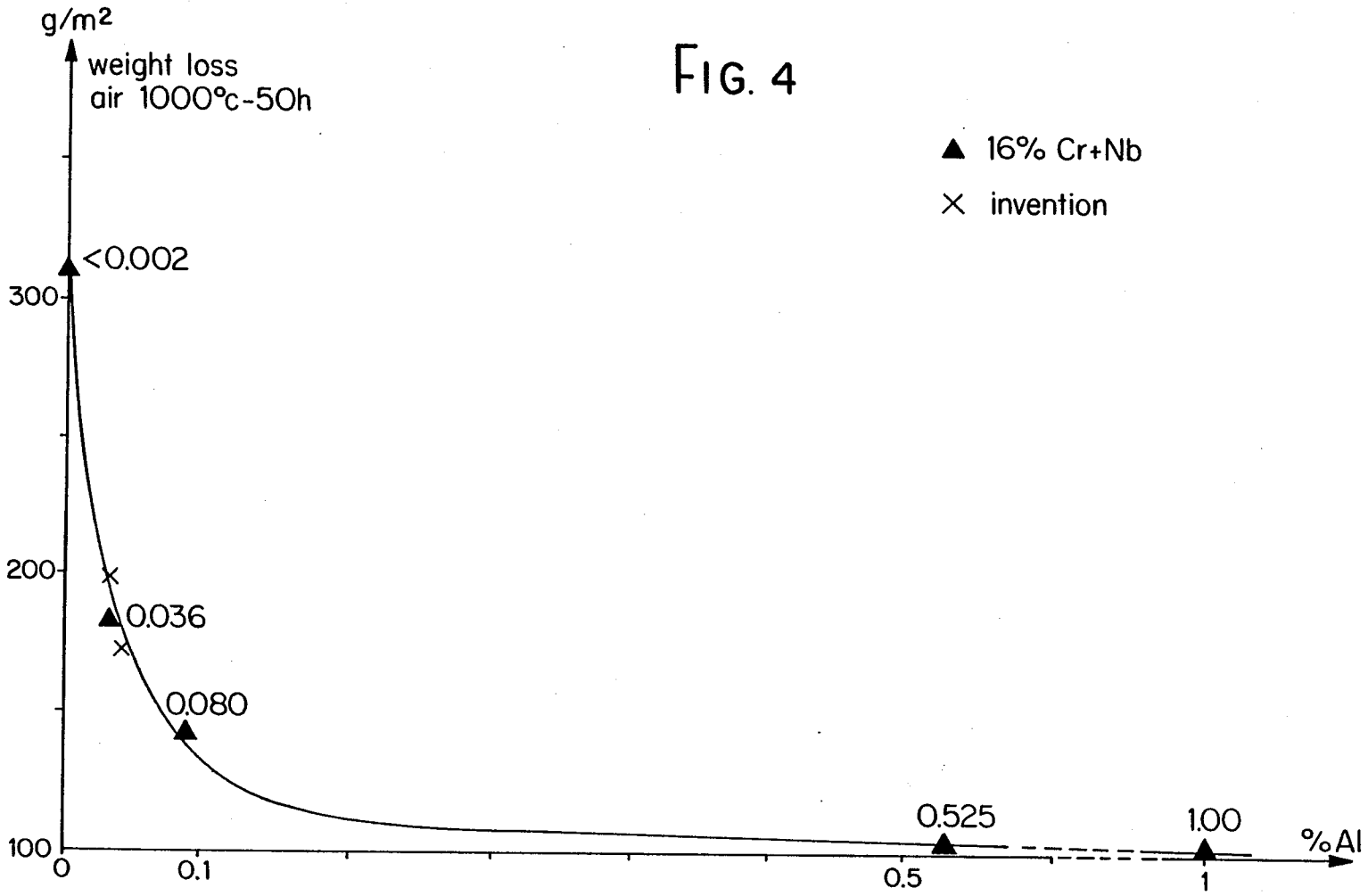

The amounts of Al are plotted in the graph shown in FIG. 4.

Test series No 5—Tests in respect of alternate oxidation at between 800° and 1000° C., in the full sheet and at a weld In these tests in respect of alternate or cyclic oxidation, the testpieces prepared as described above are subjected to cycles which each comprise: rapid heating, holding for 10 minutes at the test temperature and then cooling in air and holding at ambient temperature or a temperature close thereto, for a total period of 10 minutes. The duration of a test is 100 hours during which 300 cycles are effected, giving an overall period for which the testpieces are held at the test temperature of 50 hours.

In that way, with test temperatures which differ from each other by 50° C. at from 800° C. to 1000° C., tests were carried out on testpieces produced from Nb+Al casting No 101 and castings Nos 201 and 202 according to the invention; analysis in respect thereof is set forth in Table 7. The tests involve both full-sheet testpieces as well as testpieces which contain welds, the welds being produced as specified in relation to test series No 2, the right or front side of the welds then occupying one third of the width of the testpieces.

Figure 5:
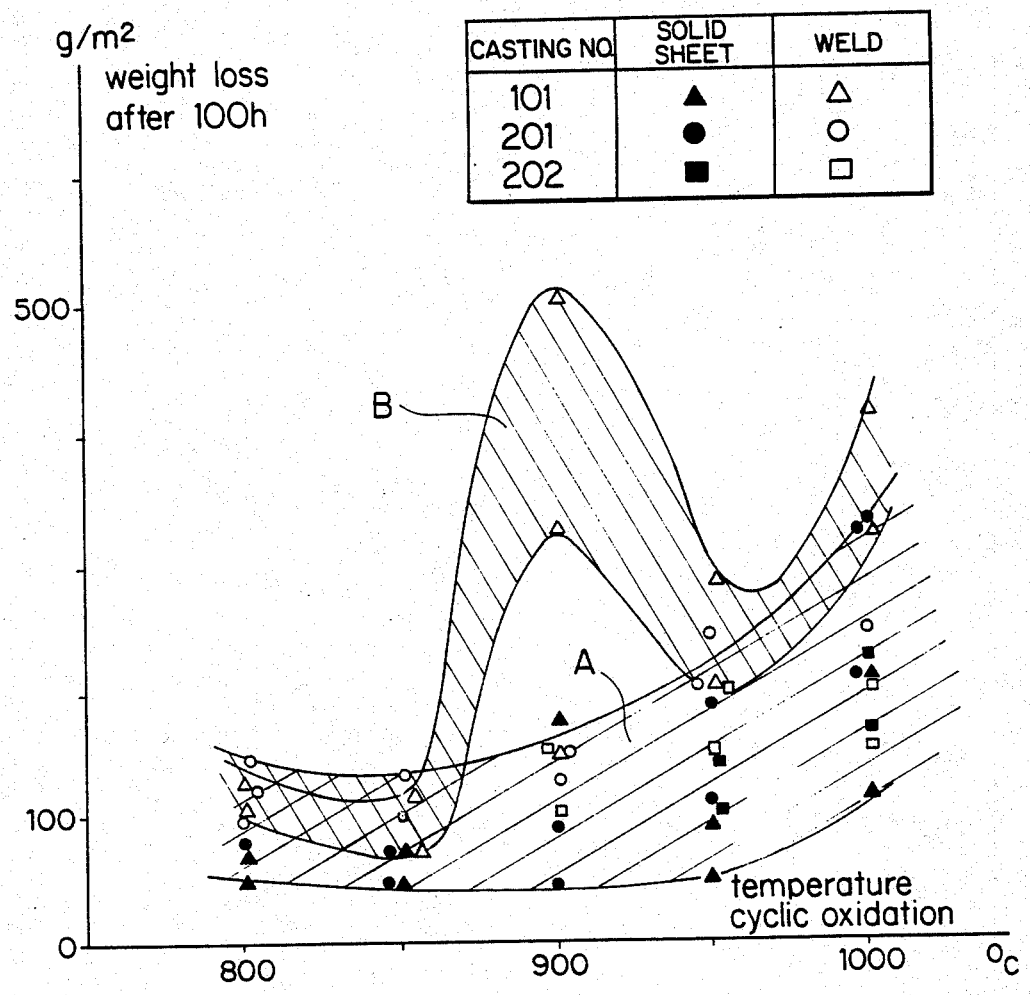

The results obtained are set forth in Table 10 and FIG. 5. FIG. 5 shows the points which are representative of the minima and maxima of each group of three results. Two families of results are to be found:

the points which are representative of the full-sheet testpieces of the three castings and those of the testpieces with a weld of castings Nos 201 and 202 according to the invention, falling in the hatched area (A);

the points which are representative of the testpieces with weld of casting No 101, which has an anomaly in respect of weight loss (excessive oxidation in this cyclic test) between 850° and 950° C., and gives relatively substantial weight losses for 1000° C. Those points are contained in the hatched area (B).

With the same proportion of Al, the sheets according to the invention are therefore distinguished from sheets with Nb and without Zr, in that their welds without filler metal provide better resistance to alternate or cyclic oxidation in that temperature range (850° to 950° C.), which is an important one in regard to exhaust manifolds.

Test series No 6—Tests in respect of alternate oxidation for 500 hours at 800° C.

This test series involved carrying out tests in respect of alternate or cyclic oxidation with a total duration of 100 hours, 250 hours and 500 hours, with the cycles defined in test series No 5. The tests related to castings Nos 101, 102 and 201 (the analysis in respect thereof being set forth in Table 7): being castings which respectively contain Nb, Zr, and Zr+Nb according to the invention, with similar amounts of Al.

Figure 6:
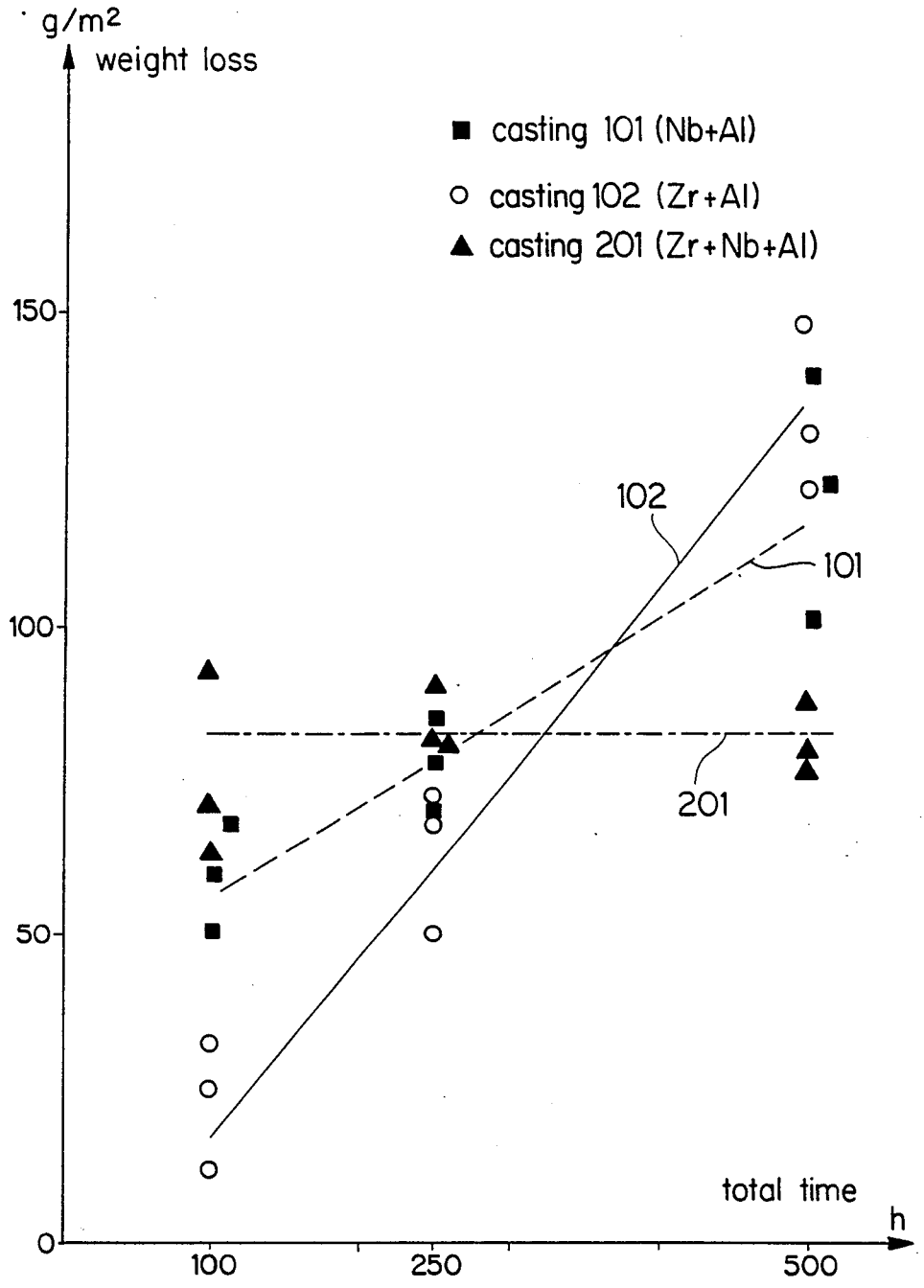

The results obtained which have already been referred to in the Statement of the Invention are set forth in Table 11 and in FIG. 6 The results of castings Nos 101 and 201 for 100 hours (at 800° C.) are already set forth in Table 10. It is noted that the variation in the loss of weight in dependence on the duration of the alternate or cyclic oxidation process is fairly different for the three castings: casting No 201 which gave the greatest weight losses at 100 hours gives weight losses which are closely grouped and which remain virtually unchanged beyond 100 hours to 250 hours, while casting No 101 and in particular casting 102 give results which increase substantially with duration. Here, casting No 201 according to the invention outclasses castings Nos 101 and 102 after about 350 hours of test.

That performance on the part of the testpieces from casting No 201, corresponding to a particular degree of stability of the layer of oxide in regard to cyclic oxidation seems to confirm that such stability, which seems to be linked to an anchoring phenomenon, does not depend only on the presence of the aluminium. By comparison with the performance of the testpieces from castings Nos 101 and 102, it seems to mean that the simultaneous presences of Zr and Nb also play a part.

ADVANTAGES OF THE INVENTION

The sheets according to the invention thus have many advantages, providing a solution to the problem set:

(a) Good resistance to hot creep, in particular with 0.30 to 0.52% of free Nb;

(b) said resistance to creep is achieved as from an industrially advantageous annealed condition, typically at 1000±10° C. for a period of 0.5 to 5 minutes;

(c) good resistance to continuous hot oxidation, which is surprisingly linked to the addition of a small amount of Al, in conjunction with Nb;

(d) a particular degree of stability of the layer of oxide in regard to cyclic oxidation at 800° C., which is linked to the simultaneous presence of Zr and Nb at the same time as a small proportion of Al;

(e) good performance on the part of the welds without filler metal in regard to cyclic oxidation, particularly in the vicinity of 900° C., such performance remaining close to that of the full sheet;

(f) good ductility of the welds without filler metal; and (g) good resistance to corrosion under conditions corresponding to the use of motor vehicle exhaust manifolds, by virtue of the limitation of the amount of Al.

USES

The strips or sheets according to the invention, usually in the tempered condition and of a thickness of from 0.6 to 3 mm and in most cases 1.2 to 2.5 mm, are employed for any use which involves looking for an economic compromise in respect of ductility (sheet and welds), hot resistance (creep, continuous or cyclic oxidation in the air) and resistance to corrosion. Use for exhaust systems is particularly typical.

TABLE 2

SAGTEST tests and tests of bending the welds
Analysis of the castings with Nb + Al (% by weight)

| Casting No | 497 | 498 | 901 | 495 | 058 | 377 |
|---|---|---|---|---|---|---|
| C | 0.030 | 0.027 | 0.017 | 0.027 | 0.022 | 0.019 |
| N | 0.036 | 0.032 | 0.024 | 0.031 | 0.033 | 0.018 |
| C + N | 0.066 | 0.059 | 0.041 | 0.058 | 0.055 | 0.037 |
| Si | 0.240 | 0.241 | 0.268 | 0.237 | 0.393 | 0.408 |
| Mn | 0.461 | 0.0453 | 0.445 | 0.458 | 0.412 | 0.522 |
| Cr | 16.38 | 16.86 | 16.11 | 16.67 | 16.28 | 16.50 |
| Mo | 0.025 | 0.025 | 0.022 | 0.026 | 0.030 | 0.030 |
| Ni | 0.148 | 0.134 | 0.150 | 0.140 | 0.236 | 0.218 |
| Ti | 0.005 | 0.004 | 0.013 | 0.005 | 0.006 | 0.006 |
| Cu | 0.030 | 0.031 | 0.031 | 0.029 | 0.005 | 0.002 |
| S | 0.007 | 0.006 | 0.005 | 0.008 | 0.007 | 0.004 |
| P | 0.029 | 0.025 | 0.025 | 0.026 | 0.025 | 0.031 |
| Zr | 0.004 | 0.002 | 0.003 | 0.004 | 0.005 | 0.006 |
| 7 (C + N) | 0.462 | 0.413 | 0.287 | 0.406 | 0.385 | 0.259 |
| Nb | 0.493 | 0.581 | 0.463 | 0.727 | 0.713 | 0.794 |
| Non-combined Nb | 0.035 | 0.170 | 0.179 | 0.325 | 0.333 | 0.541 |
| Al | 0.038 | 0.038 | 0.031 | 0.037 | 0.029 | 0.033 |

TABLE 3

SAGTEST tests and tests of bending of welds
Analysis of the castings with Zr + Nb + Al (% by weight)

| Casting No | 426 | 427 | 307 | 445 | 308 | 446 | 428 |
|---|---|---|---|---|---|---|---|
| C | 0.022 | 0.031 | 0.017 | 0.031 | 0.018 | 0.025 | 0.022 |
| N | 0.018 | 0.015 | 0.010 | 0.009 | 0.017 | 0.012 | 0.018 |
| C + N | 0.040 | 0.046 | 0.027 | 0.040 | 0.035 | 0.037 | 0.040 |
| Si | 0.385 | 0.370 | 0.289 | 0.428 | 0.367 | 0.390 | 0.419 |
| Mn | 0.488 | 0.459 | 0.439 | 0.496 | 0.433 | 0.496 | 0.503 |
| Cr | 16.66 | 16.53 | 16.18 | 16.42 | 16.53 | 16.38 | 16.32 |
| Mo | 0.032 | 0.036 | 0.047 | 0.029 | 0.045 | 0.033 | 0.041 |
| Ni | 0.154 | 0.230 | 0.214 | 0.217 | 0.211 | 0.202 | 0.232 |
| Ti | 0.006 | 0.005 | 0.006 | 0.005 | 0.006 | 0.006 | 0.006 |
| Cu | 0.002 | 0.004 | 0.003 | 0.005 | 0.003 | 0.004 | 0.003 |
| S | 0.006 | 0.005 | 0.010 | 0.005 | 0.007 | 0.004 | 0.004 |
| P | 0.033 | 0.033 | 0.028 | 0.030 | 0.025 | 0.029 | 0.031 |
| Zr | 0.261 | 0.222 | 0.436 | 0.245 | 0.259 | 0.259 | 0.234 |

TABLE 3-continued

| SAGTEST tests and tests of bending of welds Analysis of the castings with Zr + Nb + Al (% by weight) | | | | | | | |
|---|---|---|---|---|---|---|---|
| Casting No | 426 | 427 | 307 | 445 | 308 | 446 | 428 |
| 7 (C + N) | 0.280 | 0.322 | 0.189 | 0.280 | 0.245 | 0.259 | 0.280 |
| Nb | 0.115 | 0.207 | 0.189 | 0.312 | 0.385 | 0.515 | 0.570 |
| Non-combined Nb | 0.096 | 0.107 | 0.189 | 0.277 | 0.385 | 0.515 | 0.524 |
| Al sol. | 0.026 | 0.024 | 0.039 | 0.031 | 0.038 | 0.032 | 0.021 |

TABLE 4

| SAGTEST results on testpieces from Nb + Al castings (sag after 100 hours at 850° C.) | | | | | | | |
|---|---|---|---|---|---|---|---|
| Casting No | | 497 | 498 | 901 | 495 | 058 | 377 |
| Non-combined Nb (% by weight) | | 0.035 | 0.170 | 0.179 | 0.325 | 0.333 | 0.541 |
| Mean sag (cm) | Annealing 1000° C. 1 min | >6(+) | — | 4.1 | 2.6 | 2.3 | 1.4 |
| | Annealing 1000° C. 5 min | >6(+) | 2.2 | 1.5 | 1.1 | 1.5 | 1.1 |

(+)for such sag, the testpieces are removed from their supports.

TABLE 5

| SAGTEST results on testpieces from Zr + Nb + Al castings (sag after 100 hours at 850° C.) | | | | | | | | |
|---|---|---|---|---|---|---|---|---|
| Casting No | | 426 | 427 | 307 | 445 | 308 | 406 | 428 |
| Non-combined Nb (% by weight) | | 0.096 | 0.107 | 0.189 | 0.277 | 0.385 | 0.515 | 0.524 |
| Mean sag (cm) | Annealing 1000° C. 1 min | 2.8 | 2.5 | 2.6 | 2.1 | 1.1 | — | 2.1 |
| | Annealing 1000° C. 5 min | 1.5 | 2.6 | 1.6 | 1.6 | 0.8 | 1.2 | 1.4 |

TABLE 7

| Tests of hot oxidation Analysis of the castings (% by weight) | | | | | | | | | |
|---|---|---|---|---|---|---|---|---|---|
| Casting No | 401 | 402 | 403 | 404 | 405 | 101 | 102 | 201 | 202 |
| C | 0.023 | 0.023 | 0.022 | 0.025 | 0.023 | 0.026 | 0.038 | 0.019 | 0.030 |
| N | 0.012 | 0.013 | 0.014 | 0.014 | 0.019 | 0.020 | 0.013 | 0.010 | 0.014 |
| C + N | 0.035 | 0.036 | 0.036 | 0.039 | 0.042 | 0.046 | 0.051 | 0.029 | 0.044 |
| Si | 0.511 | 0.545 | 0.528 | 0.550 | 0.259 | 0.461 | 0.520 | 0.332 | 0.373 |
| Mn | 0.458 | 0.460 | 0.479 | 0.478 | 0.643 | 0.547 | 0.400 | 0.502 | 0.433 |
| Cr | 16.15 | 15.96 | 15.93 | 15.98 | 16.19 | 15.92 | 16.85 | 16.49 | 16.41 |
| Mo | 0.028 | 0.038 | 0.038 | 0.039 | 0.155 | 0.058 | 0.015 | 0.063 | 0.011 |
| Ni | 0.193 | 0.199 | 0.194 | 0.205 | 0.193 | 0.262 | 0.160 | 0.225 | 0.123 |
| Ti | — | — | — | — | — | — | — | — | — |
| Cu | — | — | — | — | — | — | — | — | — |
| S | 0.007 | 0.005 | 0.005 | 0.005 | 0.004 | 0.007 | 0.007 | 0.004 | 0.002 |
| P | 0.023 | 0.023 | 0.022 | 0.023 | 0.015 | 0.024 | 0.022 | 0.034 | 0.025 |
| Zr | — | — | — | — | — | — | 0.565 | 0.301 | 0.236 |
| 7 (C + N) | 0.245 | 0.252 | 0.252 | 0.273 | 0.294 | 0.322 | 0.357 | 0.203 | 0.308 |
| Nb | 0.452 | 0.463 | 0.443 | 0.450 | 0.505 | 0.601 | — | 0.464 | 0.353 |
| Non-combined Nb | 0.207 | 0.211 | 0.191 | 0.177 | 0.211 | 0.279 | — | 0.464 | 0.281 |
| Al | <0.002 | 0.036 | 0.090 | 0.525 | 1.00 | 0.048 | 0.041 | 0.041 | 0.039 |

TABLE 10

| Weight loss (g/m²) after cyclic oxidation for a period of 100 hours | | | | | |
|---|---|---|---|---|---|
| Casting No | 800° C. | 850° C. | 900° C. | 950° C. | 1000° C. |
| 101 | 68 | 50 | 178 | 95 | 120 |
| Solid sheet | 60 | 74 | 149 | 53 | 218 |
| | 52 | 67 | 167 | 78 | 138 |
| 101 | 104 | 119 | 334 | 293 | 327 |
| Weld | 124 | 73 | 377 | 198 | 391 |
| | 132 | 109 | 515 | 202 | 423 |
| 201 | 63 | 48 | 90 | 196 | 216 |
| Solid sheet | 71 | 73 | 47 | 123 | 338 |

TABLE 10-continued

| Weight loss (g/m²) after cyclic oxidation for a period of 100 hours | | | | | |
|---|---|---|---|---|---|
| Casting No | 800° C. | 850° C. | 900° C. | 950° C. | 1000° C. |
| | 93 | 50 | — | 114 | 315 |
| 202 | — | — | — | 105 | 227 |
| Solid sheet | | | | 117 | 196 |
| | | | | 143 | 171 |
| 201 | 140 | 102 | 153 | 247 | 253 |
| Weld | 125 | 103 | 131 | 207 | 292 |
| | 163 | 128 | — | 218 | 311 |
| 202 | | | 157 | 195 | 209 |
| Weld | | | 109 | 213 | 174 |
| | | | 133 | 159 | 156 |

TABLE 11

| Weight loss (g/m²) after cyclic oxidation for a variable duration at 800° C. | | | |
|---|---|---|---|
| | Total duration | | |
| Casting No (type) | 100 h | 250 h | 500 h |
| 101 | 52 | 72 | 102 |
| (with Nb + Al) | 60 | 80 | 125 |
| | 68 | 86 | 142 |
| 102 | 12 | 51 | 124 |
| (with Zr + Al) | 24 | 69 | 133 |
| | 32 | 73 | 153 |
| 201 | 63 | 82 | 79 |
| (with Zr + Nb + Al) | 71 | 83 | 82 |
| | 93 | 92 | 89 |

We claim:

1. Ferritic stainless steel strip or sheet which is intended in particular for the production of exhaust systems, consisting essentially of, in % by weight:

$(C+N)<0.060$;
$Si<0.9$;
$Mn<1$;
$Cr=15$ to 19;
$Mo<1$;
$Ni<0.5$;
$Ti<0.1$;
$Cu<0.4$;
$S<0.02$;
$P<0.045$;
$Zr=0.10$ to 0.40, and $7(C+N)\leqq Zr\leqq 7(C+N)+0.15$;
$Nb=0.25$ to 0.55, in non-combined form;
$Al=0.020$ to 0.080; and
Fe, balance, wherein the Al is in solid solution except for an amount which is no greater than 0.003%.

2. Ferritic stainless steel strip or sheet according to claim 1, wherein $(C+N)<0.040$.

3. Ferritic stainless steel strip or sheet according to claim 1, wherein Nb=0.30 to 0.52.

4. Ferritic stainless steel strip or sheet according to claim 1, wherein:

$(C+N)<0.040$;
Cr=16 to 18;
$Ni<0.3$;
Nb=0.33 to 0.50; and
Al=0.020 to 0.045.

5. Process for the production of ferritic stainless steel strip or sheet consisting essentially of, in % by weight:

$(C+N)<0.060$;
$Si<0.9$;
$Mn<1$;
Cr=15 to 19;
$Mo<1$;
$Ni<0.5$;
$Ti<0.1$;
$Cu<0.4$;
$S<0.02$;
$P<0.045$;
Zr=0.10 to 0.50, and
$7(C+N)-0.1 \leqq Zr \leqq 7(C+N)+0.2$;
Nb=0.25 to 0.55, when $Zr \geqq 7(C+N)$;
$Nb=0.25+7(C+N)-Zr$ to $0.55+7(C+N)-Zr$ when $Zr<7(C+N)$;
Al=0.020 to 0.080; and
Fe, balance, wherein the Al is in solid solution except for an amount which is no greater than 0.003%, comprising the steps of:

hot rolling to a thickness between 2.5 and 5 mm;
annealing the hot rolled strip or sheet at 800° to 1000° C. under substantially non-oxidizing conditions;
shot blasting to clean the annealed strip or sheet;
cold rolling the shot blasted strip or sheet to a delivery thickness between 0.6 and 3 mm;
final annealing the cold rolled strip or sheet at between 980° and 1020° C.; and
subjecting the final annealed strip or sheet to a cold working pass or "skin" pass producing a degree of elongation of less than 1%.

6. Process according to claim 5, additionally comprising intermediate annealing and cleaning the strip or sheet following the step of cold rolling.

7. Process according to claim 5 or 6, wherein the final annealing is carried out at 990° C. to 1010° C. for 0.5 to 5 minutes.

8. Process according to claim 5 or 6, wherein $(C+N)<0.040$.

9. Process according to claim 5 or 6, wherein Nb=0.30 to 0.52.

* * * * *